US007471177B2

(12) United States Patent
Jacobus

(10) Patent No.: US 7,471,177 B2
(45) Date of Patent: Dec. 30, 2008

(54) ACTUATING DEVICE

(75) Inventor: Heinz Jacobus, Dudweiler (DE)

(73) Assignee: Hydac Electronic GmbH, Saarbrücken (DE)

( * ) Notice: Subject to any disclaimer, the term of this patent is extended or adjusted under 35 U.S.C. 154(b) by 274 days.

(21) Appl. No.: 11/597,419

(22) PCT Filed: Apr. 1, 2005

(86) PCT No.: PCT/EP2005/003419

§ 371 (c)(1),
(2), (4) Date: Nov. 22, 2006

(87) PCT Pub. No.: WO2005/124934

PCT Pub. Date: Dec. 29, 2005

(65) Prior Publication Data

US 2007/0246668 A1 Oct. 25, 2007

(30) Foreign Application Priority Data

Jun. 16, 2004 (DE) ..... 10 2004 029 185

(51) Int. Cl.
*H01R 13/52* (2006.01)
*H01F 27/04* (2006.01)
*H01F 7/08* (2006.01)

(52) U.S. Cl. ..... 335/282; 335/278; 336/107

(58) Field of Classification Search ..... 335/278, 335/282; 336/90, 107, 192; 251/129.01–129.22
See application file for complete search history.

(56) References Cited

U.S. PATENT DOCUMENTS

| | | | | |
|---|---|---|---|---|
| 3,521,823 | A | 7/1970 | Horssen | |
| 3,922,477 | A | 11/1975 | Glowacz | |
| 5,038,125 | A * | 8/1991 | Vogel | 335/202 |
| 6,512,440 | B2 * | 1/2003 | Suda | 336/192 |
| 6,784,778 | B2 * | 8/2004 | Stitz et al. | 336/90 |
| 7,151,427 | B2 * | 12/2006 | Muller et al. | 335/278 |
| 2004/0104795 | A1 | 6/2004 | Stitz et al. | |

FOREIGN PATENT DOCUMENTS

| | | |
|---|---|---|
| DE | 43 41 087 | 6/1995 |

* cited by examiner

*Primary Examiner*—Ramon M Barrera
(74) *Attorney, Agent, or Firm*—Roylance, Abrams, Berdo & Goodman, L.L.P.

(57) ABSTRACT

The invention relates to an actuating device, particularly an actuating magnet, for actuating valves. In order to improve the sealing action of an actuating magnet, the invention provides that a contacting plug insert (48) has a seating surface (54) against which an annular sealing part (52) rests and which extends in the form of a groove inside the plug insert (48). The groove depth is selected so that, when in an unpressed state, approximately half of the sealing part (52) is accommodated inside the groove (56). When the groove (56) is fitted with the sealing part (52), it is completely filled whereby resulting in a projection that sealingly closes the gap (58) arising between a plug plate (40) and an outer peripheral surface (50) of the housing (18).

10 Claims, 2 Drawing Sheets

ACTUATING DEVICE

The invention relates to an actuating device, in particular an actuating magnet, for actuating valves, having a housing and a coil element located therein, a coil element in which a switching component is guided, and which is provided with the winding of a conductor which is connected by a retaining device to contact components of a plug plate which is seated on the outer peripheral surface of the housing while maintaining a distance by means of a plug insert, the plug insert for seating an annular sealing component having a seating surface which extends in the form of a groove within the plug insert, and in the installed state, by pressing the sealing component, at least the gap, which is formed in the direction of the coil element between the plug plate and the outer peripheral surface of the housing, being closed to effect sealing.

These actuating devices which are also termed actuating magnets are known and are freely available commercially in a host of versions. The switching component is formed essentially from a tubular pin which, when the coil is electrically excited via a connector plug which can be connected to a plug plate, traverses a definable path and in this connection actuates an actuating or switching process, and, for example, in a valve enables blocking and routing of fluid flows. If these known actuating devices are used in regions with high humidity, as occurs among others things also with condensate formation, the moisture penetrates into the housing interior, especially to the coil element with the winding, and with the onset of corrosion leads to the device becoming unusable. To avoid this problem, it has already been suggested in the prior art that the housing of the actuating device be completely surrounded with a plastic potting mass which keeps moisture away; but this can lead to actuating devices of very large size which are not suited for use in automotive engineering, where fundamentally only little installation space is available. Moreover potting the switch housing with the plug plate can lead to an unattractive appearance of the actuating device.

To alleviate these disadvantages, in a generic actuating device as claimed in DE 43 41 087 A1 it has already been suggested that the plug insert for seating of an annular sealing component be provided with a seating surface which protrudes with a definable axial projection over the bottom of the plug plate facing the outer peripheral surface of the housing, such that in the installed state at least the gap which is formed in the direction of the coil element between the plug plate and the outer peripheral surface of the housing is closed to effect sealing by pressing the sealing component. In this way moisture can no longer travel into the housing interior at the site of the upper part of the plug plate and in particular cannot reach the coil element with the winding. In the known solution the plug insert has an inside thread and two insulation piercing inserts which are each provided with lengthwise teeth and which are separated from one another by a groove-shaped contact shoulder for holding the annular sealing component. In this way, with simple manufacture the plug insert can be securely joined both to the plug plate and also then together with the plug plate to the housing of the actuating device. Since in the known solution gap formation in the area of the plug plate between the potting mass and the outer peripheral surface of the housing is extremely narrow and in this respect is then closed by the annular sealing component in the pressed state, the sealing component in the direction of the gap is very greatly extended and compressed; this can lead to high material loading in the annular sealing component and especially due to the sharp-edge configuration of the insulation piercing inserts, damage to the sealing component is possible. This can adversely affect the sealing function such that in later operation failures of the actuating device occur, and consequently failures in the hydraulic circuits to which the actuating device is functionally connected.

On the basis of this prior art, the object of the invention is to devise an actuating device which is as small as possible and which is suited especially for use in automotive engineering and is still reliable in operation even at high humidity, even over a longer interval of use. This object is achieved by an actuating device with the features of claim 1 in its entirety.

In that, as specified in the characterizing part of claim 1, the groove depth is chosen such that in the unpressed state approximately half of the sealing component is held in the groove and that in the installation state the groove with the sealing component is completely filled except for a projection such that the gap which is formed is closed to effect sealing, the humidity at the site of the upper part of the plug plate can no longer travel into the housing interior and especially not to the coil element with the winding. In that the annular sealing component is enclosed in the groove of the plug insert, which moreover has a large volume of displacement space into which the sealing component can be displaced when injected in place with the plastic potting mass, harmful compression, shearing and transverse forces on the sealing component are also for the most part precluded; this ensures that even beyond longer periods of use the sealing function is reliably maintained. The enclosed sealing component especially to the outside preserves its partially annular sealing surface and in this way can effect sealing of the indicated gap with a high degree of elasticity. Since the groove in the plug insert can be provided on the groove bottom with rounded transitions to the transversely running side walls, sharp edge geometries which can adversely affect the sealing action within the plug insert are avoided. Without being pressed or displaced as shown in the prior art into a sealing gap which runs parallel to the lengthwise axis of the plug insert, the preferably O-ring-shaped cross section of the sealing component is preserved which for this purpose can best perform its sealing function for the gap.

Other advantageous embodiments of the actuating device as claimed in the invention are the subject matter of the other dependent claims.

The actuating device as claimed in the invention will be detailed below using one embodiment as shown in the drawings. The figures are schematic and not to scale.

Figure 1:
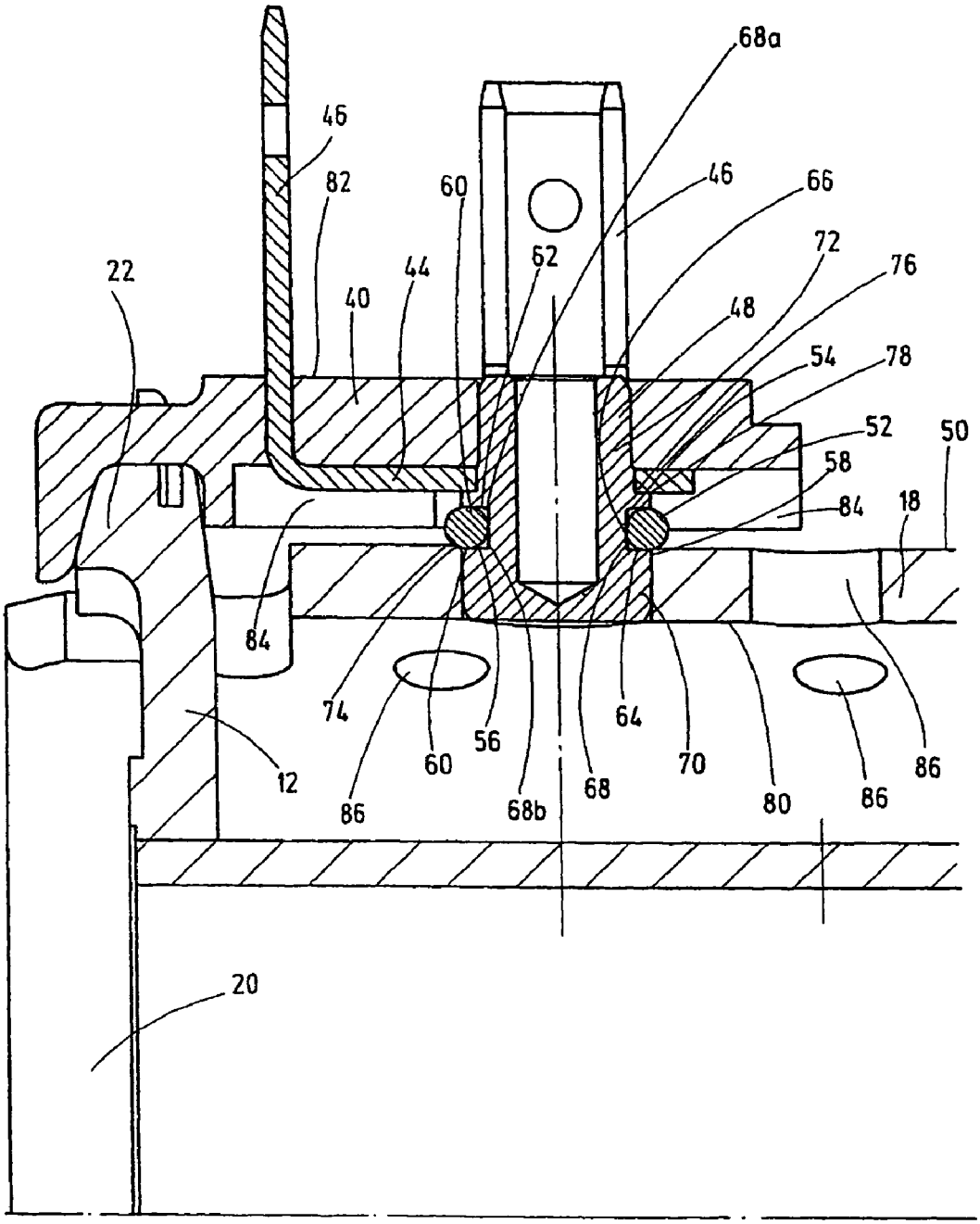
FIG. 1 shows a lengthwise section through the top half of the actuating device without the coil winding.

The switching device has a coil element 10 of plastic material, the coil element 10 on the end side having two annular flanges 12 between which the winding stack 14 of a conductor 16 extends, this coil having been omitted in FIG. 1 for the sake of simplification. A switching component (not shown) is guided in the coil element 10, and with this switching component especially hydraulic valves can be actuated and actuated. The coil element 10 is surrounded by an essentially cylindrically made housing 18 of metallic material. This structure is conventional in actuating magnets so that it will no longer be detailed here.

Figure 2:
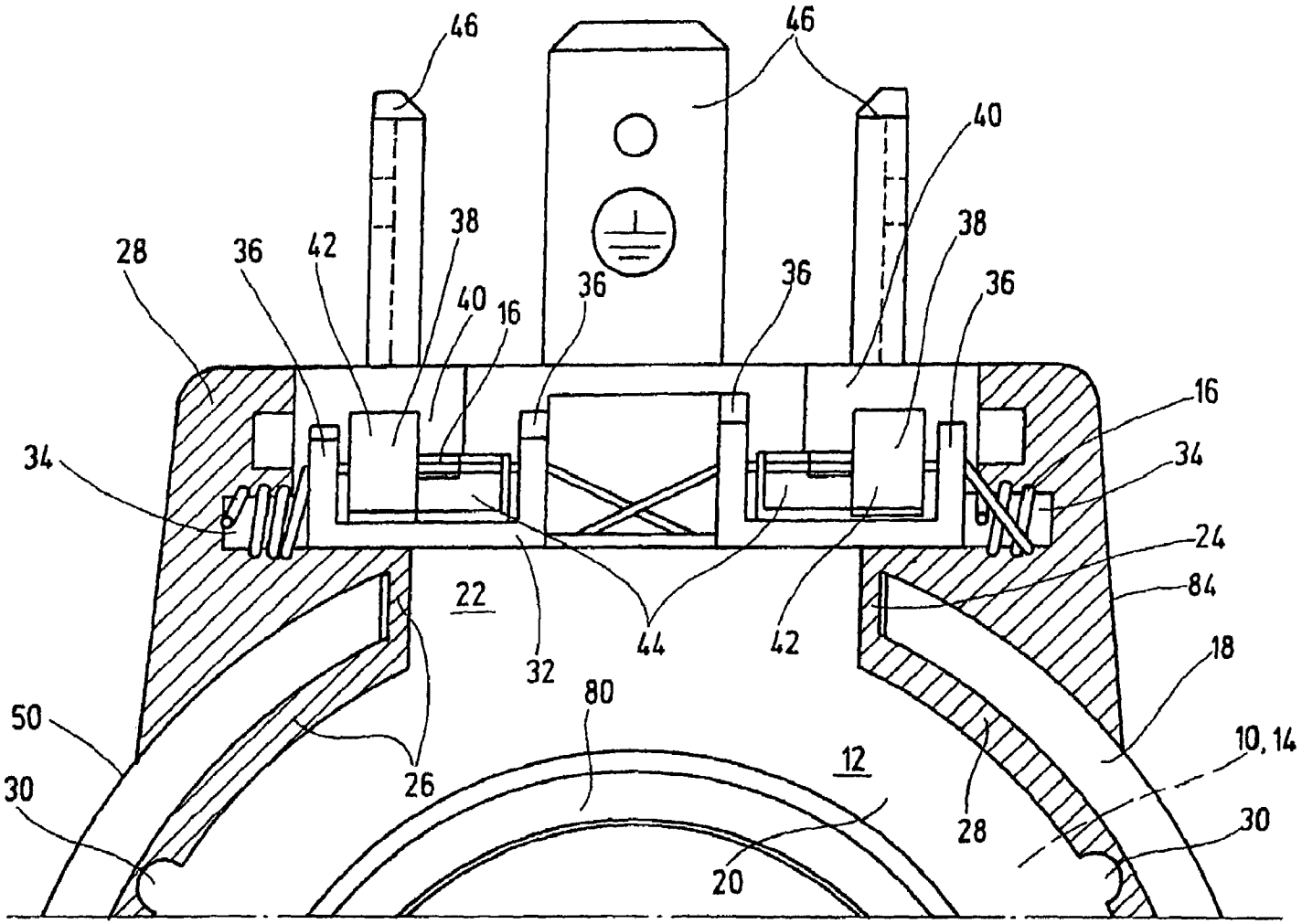
FIG. 2 shows a front view of the actuating device shown partially in a section according to FIG. 1.

The annular flange 12 of the coil element 10 which faces the vicinity forms an annular plate 20 (FIG. 2) which, with a retaining device 22 molded Unto it, extends through a front, groove-shaped recess 24 in the housing 18, both the annular plate 20 and also the retaining device 22 at least partially along their outer contour exposing a radial gap 26 to the housing parts 18 facing them; the gap can be injected with a plastic potting mass 28. For the sake of simplicity, the potting mass 28 is likewise omitted in FIG. 1. To center the annular plate 20 within the inner periphery of the housing 18, it can be held by way of radial projections 30 protruding along its outer periphery at a distance and centered in the middle for injecting or casting in place with the potting mass 28. The radial projections 30 are dimensioned such that they center the retaining device 22 relatively accurately for insertion into the casting or injection mold. After insertion into the mold however a gap forms between the housing 18 and the retaining device 22. The retaining device 22 has a middle piece 32 which is made as a plate which runs flat and which projects radially over the groove-shaped recess 24.

The retaining device 22 on the end side on the plate-shaped center piece 32 has two pin-like prolongations 34 around which the ends of the conductor 16 are wound, in order in this way to ensure a fixed link of the conductor 16 to the retaining device 22. For further guidance of the conductor 16, on the top of the middle piece 32 in each respective outer region, there are two pairs of crosspieces 36 which each have a receiver with a V-shaped cross section into which the conductor 16 can be inserted. Located in the center on the middle piece 32 and between two crosspieces 36 of the retaining device 22 which are located directly adjacently opposite, there is a guide means (not detailed), by means of which the conductor 16 crossing in the indicated region and without touching at this point is routed to run toward the winding stack 14.

The conductor 16 is routed by the retaining device 22 over a definable path between the respective pairs of crosspieces 36 such that it is freely accessible to direct contact with two contact components 38 of one plug plate 40 from at least one side, but preferably from all sides. The respective contact component 38 of the plug plate 40 has a roof-like connecting piece 42 which can be seated from the top on the conductor piece between the two crosspiece pairs 36. The two free leg pieces of each connecting piece 42 which encompass the conductor 16 within the retaining device 22 can be can be pressed together and then welded to one another, a conductive connection arising between the respective contact component 38 and the assigned piece of the conductor 16. The roof-like connecting pieces 42 are each arranged offset to the outside toward the respective prolongation 34 and are connected to one respective flat contact path 44 each, on which arranged perpendicular to it and connected to it there is the lug 46 of the plug of the plug plate 40 which projects over the top of the switching device. This contact path 40 is shown in FIG. 1 only for the ground connection which is likewise made as the lug 46 of a plug, which in the same manner as the other lugs 46 projects to the top and is designed for connection to female plug parts of a connector plug (not shown) for later power supply.

All contact paths 44 and lugs 46 of plugs can be punched or cut out of a flat plate and are then potted with the plastic material of the plug plate 40. The plug plate 40 essentially in the middle has a plug insert 48 which is designed as a cylindrical sleeve. By means of this plug insert 48 the plug plate 40 can be seated on the outer peripheral surface 50 as the outside wall of the housing 18 while maintaining a distance.

The plug insert 48 for seating of the annular sealing component 52 (FIG. 1) has a seating surface 54 which extends in the form of a groove within the plug insert 48. The depth of the groove 56 is chosen such that in the unpressed state as shown in FIG. 1 only approximately half of the sealing component 52 is accommodated. In the installed state which is not shown, by pressing the sealing component 52, as will be detailed below, the gap 58 which is formed in the direction of the coil element 10 between the plug plate 40 and the outer peripheral surface 50 of the housing 18 is closed to effect sealing. The cross section of the groove 56 is rectangular, especially square, in the unpressed state the sealing component 52 at least along two diametrically opposite sealing lines 60 adjoining the inside of the groove 56. The two side walls 62 and 64 of the groove 56 are vertical on the groove bottom 66, in the unpressed state as shown in FIG. 1, between the sealing component 52 held in the groove 56 and the groove 56 itself, a displacement space 68 is formed. The displacement space 68 itself is divided in turn into two component spaces 68*a,b* in turn via the annular sealing component 52. In order to protect the sealing component 52 consisting of an elastic material, especially rubber material, against damage in the groove base, the groove 56 in the area of the transition between its respective side walls 62, 64 and the groove bottom 66 has transitions which are arc-shaped viewed in cross section. If the annular sealing component 52 in the unpressed state as shown in FIG. 1 adjoins the groove bottom 66 with its inner periphery, in this respect another sealing line is implemented with the walls of the groove 56.

The plug insert 48 is divided by the groove 56 made on the outer peripheral side into two regions 70, 72, of which one region 70 is held in the housing 18 such that the groove 56 with its one lower side wall 64 offset by a step 74 ends with the outer peripheral surface 50 of the housing 18. In this respect, the step 74 also limits the gap 58 which is to be sealed later. The other region 72 of the plug insert 48 tapers as an indentation in the direction of the plug plate 40, and on the side facing the groove 56 in the indentation 76 formed in this way, there is a seating surface 78 for the contact component 38 of the plug plate 40 which is used as the ground connection. In particular, the plug insert 48 is formed from an electrically conductive, especially metallic material and the plug insert 48 extends through the indicated ground connection in the form of the contact component 38. The height of the plug insert 48 is chosen such that it extends between the inside wall 80 of the housing 18 to the top 82 of the plug plate 40.

Between the outer peripheral surface 50 of the housing 18 and the plug plate 40 a supply space 84 is delineated which is used to supply the potting mass 28 for sealing purposes, when the parts shown in FIG. 1 are injected in place the sealing component 52 being pressed into the displacement space 68 of the groove 56 until the elastic parts of the sealing component 52 are in contact with the side walls 62, 64 and with the bottom 66 of the groove 56. In order to facilitate the delivery of the potting mass 28, there are delivery passages 86 in the housing 18. When the sealing component 52 is pressed into the groove 56, a certain projection remains to the outside which retains essentially its arc shape and in this way seals the indicated gap 58, especially at the site of the indentation-like transition to the housing wall in the form of the step 74. In addition to the described displacement motion and the pressing of the sealing component 52 in the groove 66, due to the potting mass 28 no other forces are applied, especially no transverse or shearing forces which could damage the sealing component 52 or shift it into the groove-shaped sealing seat; this could adversely affect the sealing action.

The plug insert 48 is made as a smooth sleeve part on the outer peripheral side; but it would also be conceivable to provide ribbing or the like in order to facilitate the connection to the plastic potting mass 28. It is surprising to one with average skill in the art in the field of actuating and switching magnets that by using a conventional O-ring in a correspondingly shaped plug insert 48 relative to the known solutions a much improved sealing action is obtained for a long operating interval without the sealing component 52 preferably in the form of an O-ring being exposed to excessively damaging stresses. The component spaces 68*a,b* of the displacement space 68 which form the free spaces also form a receiving possibility for the O-ring, since temperature fluctuations, especially in the form of a temperature increase, can change the geometrical dimensions of the O-ring, especially in the form of a volumetric expansion which is accommodated by the component spaces 68*a,b*.

The invention claimed is:

1. Actuating device for actuating valves, having a housing (18) and a coil element (10) located therein, a coil element in which a switching component is guided, and which is provided with the winding (14) of a conductor (16) which is connected by a retaining device (22) to contact components (38) of a plug plate (40) which is seated on the outer peripheral surface (50) of the housing (18) while maintaining a distance by means of a plug insert (48), the plug insert (48) for seating an annular sealing component (52) having a seating surface (54) which extends in the form of a groove within the plug insert (48), and, in the installed state, by pressing the sealing component (52) at least the gap (58), which is formed in the direction of the coil element (10) between the plug plate (40) and the outer peripheral surface (50) of the housing (18), being closed to effect sealing, characterized in that the groove depth is chosen such that in the unpressed state approximately half of the sealing component (52) is held in the groove (56) and in that in the installed state the groove (56) with the sealing component (52) is completely filled except for a projection which sealingly closes the gap (58) which is formed.

2. The actuating device as claimed in claim 1, wherein the cross section of the groove (56) is rectangular and wherein in the unpressed state the sealing component (52) at least along two diametrically opposite sealing lines (60) adjoins the wall of the groove (56).

3. The actuating device as claimed in claim 1, wherein the two side walls (62, 64) of the groove (56) stand vertically on the groove bottom (66) and wherein in the unpressed state between the sealing component (52) held in the groove (56) and the groove (56) itself a displacement space (68) is formed.

4. The actuating device as claimed in claim 3, wherein the displacement space (68) is divided into two component spaces (68*a,b*) and wherein the division is effected by way of the sealing component (52).

5. The actuating device as claimed in claim 1, wherein the plug insert (48) is divided by the groove (56) made on the outer peripheral side into two regions (70, 72), of which one region (70) is accommodated in the housing (18) such that the groove (56) with its one side wall (64) ends flush or offset by a step (74) with the outer peripheral surface (50) of the housing (18).

6. The actuating device as claimed in claim 5, wherein the other region (72) of the plug insert (48) tapers as an indentation in the direction of the plug plate (40) and wherein on the side facing the groove (56) the indentation (76) formed has a seating surface (78) for at least a contact component (38) of the plug plate (40) which is used as a connection.

7. The actuating device as claimed in claim 6, wherein the plug insert (48) is formed from an electrically conductive material and wherein the plug insert (48) extends through the ground connection.

8. The actuating device as claimed in claim 1, wherein the height of the plug insert (48) is chosen such that it extends between the inside wall (80) of the housing (18) to the top (82) of the plug plate (40).

9. The actuating device as claimed in claim 4, wherein between the outer peripheral surface (50) of the housing (18) and the plug plate (40) a supply space (84) is delineated which is used to supply the potting mass (28) for sealing purposes, partially displaces the sealing component (52) into the displacement space (68) of the groove (56).

10. The actuating device as claimed in claim 1, wherein the annular sealing component (52) is formed from a round gasket, especially from an O-ring.

* * * * *